US005967074A

United States Patent [19]

Frantl et al.

[11] Patent Number: 5,967,074

[45] Date of Patent: Oct. 19, 1999

[54] KEEL FOR SAIL SHIPS

[76] Inventors: Erich Frantl, Laudongasse 33/76, A-1080 Wien; Werner Frantl, Tagliebergasse 6/17/13, A-1230 Wien, both of Austria

[21] Appl. No.: 09/012,229

[22] Filed: Jan. 23, 1998

[30] Foreign Application Priority Data

Jan. 24, 1997 [AT] Austria ..... 103/97

[51] Int. Cl.[6] ..... B63B 41/00; B63B 3/38

[52] U.S. Cl. ..... 114/143; 114/132

[58] Field of Search ..... 114/280, 140, 114/143, 39.1, 132, 133, 134, 135, 136, 137; 440/112

[56] References Cited

U.S. PATENT DOCUMENTS

| | | | |
|---|---|---|---|
| 4,094,263 | 6/1978 | Marcil | 114/91 |
| 4,352,335 | 10/1982 | Sugden | 114/143 |
| 4,817,550 | 4/1989 | Gutsche | 114/124 |
| 5,009,178 | 4/1991 | Geffken | 114/143 |
| 5,152,238 | 10/1992 | Page . | |
| 5,280,760 | 1/1994 | Edwards . | |
| 5,522,703 | 6/1996 | Okamoto | 416/93 |
| 5,795,198 | 8/1998 | Pedone | 440/2 |

FOREIGN PATENT DOCUMENTS

| | | | |
|---|---|---|---|
| 2 658 477 | 8/1991 | France . | |
| 2 254 205 | 5/1974 | Germany . | |
| 29 22 629 | 12/1980 | Germany . | |
| 29 47 523 | 6/1981 | Germany . | |
| WO96/05100 | 8/1995 | Monaco | 23/36 |
| 2 232 126 | 12/1990 | United Kingdom . | |
| WO 87/00136 | 1/1987 | WIPO . | |

OTHER PUBLICATIONS

"America's Cup'88", pp. 128–134, Yacht, Jan. 5, 1988.

"Neuer Kiel aus Holland", p. 13, Yacht, Mar. 9, 1994.

*Primary Examiner*—Sherman Basinger
*Assistant Examiner*—Patrick Muldoon
*Attorney, Agent, or Firm*—Young & Thompson

[57] ABSTRACT

A sailing yacht, in addition to its ballast keel (2), has at least one winged keel ( ) which optionally also carries ballast. Both ballast keel (2) and winged keel (1) are mounted to swivel on the hull of the sail ship around an axis aligned essentially in the longitudinal direction of the sail ship. Thus, by swivelling ballast keel (2) the righting moment is changed, for example, increased. By swivelling winged keel (1) its lateral plane part can be changed and thus can be kept large even when the sailing yacht is heeling.

32 Claims, 10 Drawing Sheets

10
29
28
26
22,23
24,25
3
27
4
30
1a,2a
1,2
19,19a
8,18
31
32
33
21
20

KEEL FOR SAIL SHIPS

FIELD OF THE INVENTION

The invention relates to a keel for sail ships, especially single-hull sailing yachts, with at least two keel parts which are supported on the hull of the sail ship to swivel independently of one another around an axis aligned essentially in the longitudinal direction of the sail ship, using drives.

BACKGROUND OF THE INVENTION

A keel of this type is known from GB 2 232 126 A.

The primary function of a keel in sail ships, especially in single-hull sailing yachts, is on the one hand to generate the transverse force in the water necessary for sailing by enlarging the lateral plane in order to create a reaction to the transverse wind force on the sail. On the other hand, keels are used in sail ships for holding ballast to increase the stability of the ship, since the transverse wind force applied to the sail generates a moment which heels the sail ship to leeward and which therefore must be partially balanced by a corresponding countermoment of the ballast migrating windward.

When the sail ship heels, the propulsive center of gravity in the sail acts alee, the center of gravity of resistance to propulsion of the entire wetted area of the underwater hull including the keel however lies windward. The interval between the resulting propulsive force in the sail and the resulting resistance force in the water generates a moment which makes the ship carry weather helm. In counter-steering, the rudder blade is oblique to the direction of travel and generates an additional flow resistance. Balancing by shifting the aerodynamic center of the sail to in front of the lateral center of gravity in the longitudinal axis of the ship does produce a countermoment in the direction of leewardliness, but this moment due to its fixed lever length represents a given value, conversely the moment causing the windwardness has a different lever length depending on the heel. Therefore compensation of the two moments is not possible in all positions.

Another disadvantage of conventional keel designs is that the lateral plane, when the ship heels, is reduced by the sloped position of the keel fin so that the drift of the sail ship increases.

To avoid running aground in shallow water, especially in the vicinity of land or in harbor basins, either a long keel with shallow draft and large ballast is used, which greatly increases the total weight of the sail ship and thus also the wetted area of the hull, and thus causes increased resistance in the water. Bilge keels, keels swivelling to the rear or lifting keels are also known, the first two not having acceptable hydrodynamic properties. A lifting keel requires an extremely disruptive keel box which lies within the yacht.

Hydrodynamically most favorable are deep draft keels which are short in the longitudinal direction of the ship, therefore keels with a large extension and ideal profile cross sections. In addition to less ballast, because it is lower, and thus smaller wetted area with the same hydrostatic stability, these keels also have the lowest "induced resistance" as the largest resistance portion of known keel shapes. This resistance is caused by the pressure equalization around the lower edge of the keel from the pressurized lee side of the keel to the negative pressurized windward side of the keel, since the flow eddy which forms is extremely unfavorable. A reduction of induced resistance is only possible by partially suppressing the flow around the lower edge of the keel by wings. But they increase the wetted area and thus the frictional resistance of the underwater hull.

As the ship size increases however an appropriate draft becomes a problem, as already mentioned, due to channels. If the intention is to achieve the same efficiency of a keel of a 12 meter yacht with a draft of for example 2.35 meters in a yacht 30 meters long, it would have to have a keel depth of 6.35 meters.

As the size of the ship increases therefore at limited draft, to approach less deep harbors the conditions become more and more unfavorable. The extension becomes smaller and the ballast center of gravity is higher in relative terms. Stability decreases if balance is not created by a high ballast weight.

SUMMARY OF THE INVENTION

The object of the invention is to develop a sail ship with a keel, especially a sailing yacht, such that the keel can be adapted to the given operating conditions without adversely affecting the sailing properties, but rather advantageously supporting them.

As claimed in the invention this is achieved in a sail ship with the features of claim 1.

Advantageous and preferred embodiments of the sail ship as claimed in the invention are the subject of the subclaims.

One or more of the following advantages accrue with the invention and its preferred embodiments, depending on the embodiment of the invention.

In the invention, by dividing the keel into a (deep) winged keel responsible for the lateral plane with a large extension, and a (deep) ballast keel responsible for the righting moment, the two keels having the capacity to be swivelled independently of one another transversely to the longitudinal axis of the sail ship, it is possible to adapt the keel to the conditions prevailing at any time by swivelling its keel parts. By changing the position of the ballast keel on the one hand and/or the winged keel on the other, the properties of the sail ship with the keel divided into at least one winged keel and at least one ballast keel as claimed in the invention can therefore be adapted to the conditions prevailing at the time both when sailing and at anchor.

In deep water a large extension and low induced resistance can be achieved by deep draft and low ballast center of gravity and therefore a low ballast portion with the same stability of the sail ship, by which the displacement of the sail ship is reduced. In shallow bays or harbors or when sailing under engine power a low draft can be achieved. The lateral plane part of the keel divided as claimed in the invention can be maintained in any position in spite of heeling. The parts of the keel, especially the winged keel, must not drift windward during heeling, so that weatherliness is reduced and the transverse force under water remains the same. The ballast keel can be swung windward for this purpose, by which the righting moment is increased. For severe heeling, for example, in a squall, the keel ballast swung windward under certain circumstances will rise out of the water, by which on the one hand its buoyancy is lost and thus the righting moment of the ballast keel is further increased, on the other hand, the wetted area of the keel ballast is lost, resulting in the disappearance of its friction in the water.

For sail ships in harbor or at anchor, by means of the keel parts swivelled to opposite sides the heel can be reduced by shafts running transversely to the sail ship, since for the already low heel the weather-side keel part is raised above the water surface and a higher restoration moment is caused by the elimination of its buoyancy.

Both keel parts, therefore not only the ballast keel, but also the winged keel, can be equipped with ballast, for example in sea-going yachts so that they maintain balance at the same swivel angle on opposite sides, or in very sporting yachts they are made with a much higher ballast keel moment relative to the winged keel moment at the same swivel angle. In the latter case the sail yacht in harbor is only vertical when the ballast keel is swivelled less distance than the winged keel.

For larger sailing yachts or if higher course stability is desired, the division of the keel into two winged keels and a ballast keel located especially in between is possible. Alternatively, for better division of the ballast an embodiment with a winged keel which lies in the center between two ballast keels is conceivable.

Basically, the keel parts can be swung out transversely to the longitudinal axis of the ship by means of mechanical drives, for example, by means of spiral gears or worm gears which engage for example swivelling shafts of the keel parts directly or via chain transmission from the hull interior.

If during course changes, primarily when tacking, the winged keel and the ballast keel are to quickly switch to the new course, within the framework of the invention a hydraulic drive for swivelling of the two keel parts is preferred.

With the preferred hydraulic drive the swivelling of the keel parts or one thereof is possible easily and promptly, for example, by opening the valves of the pressure lines which keep the keel parts swivelled to higher positions relative to vertical. For correspondingly large line cross sections the keel parts swung out laterally by their weight drop immediately into the vertical position and are swung into the desired new position via pumps or via a hydraulic accumulator which has been correspondingly charged, for example, pressurized, beforehand. Another possibility for quickly equalizing the momentum of the two keel parts when turning consists in that the potential energy of the ballast keel, which is more strongly swung out and thus located higher, by pressure diversion into the lower winged keel lowers the former and raises the latter until the momentum is equalized. A filled line system which is provided if necessary and which lies accordingly high above the water surface by virtue of the higher hydrostatic pressure within the swivel drive prevents penetration of (sea) water via sealing joints between the rigid and the movable parts of the keel parts as claimed in the invention into the swivel drive.

To safeguard the position of keel parts swivelled up at locations with low water depths, for example in shallow bays or harbor basins, the keel parts swivelled up can be kept in their position for example by means of slings, so that the swivel drive for the keel parts is relieved.

BRIEF DESCRIPTION OF THE DRAWINGS

With reference to the attached drawings, in the following various preferred embodiments of the invention are described using the example of sailing yachts.

DETAILED DESCRIPTION OF THE INVENTION

Figures 1, 2, 3:
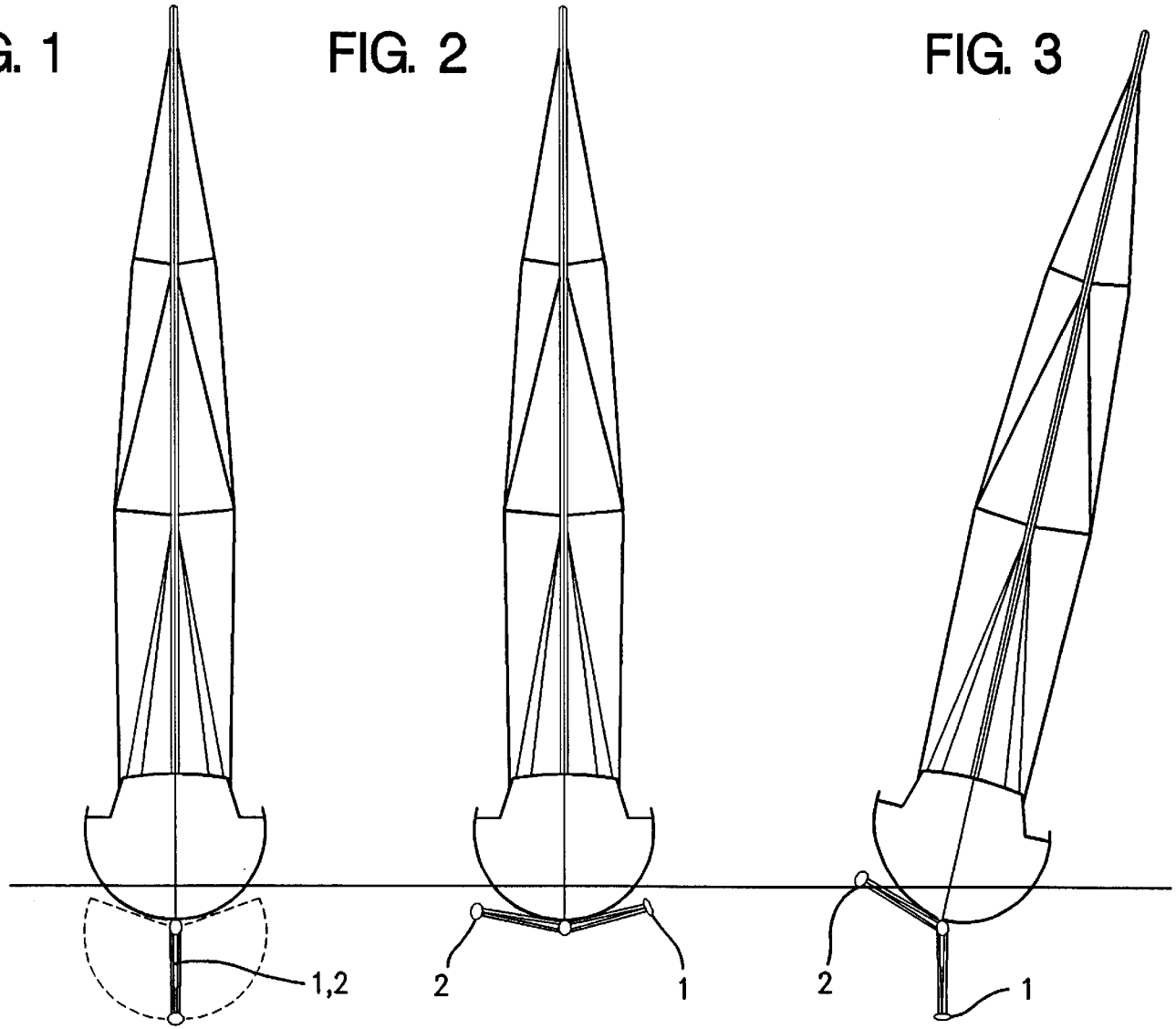
FIG. 1 shows a sailing yacht with vertically positioned winged keel and ballast keel, and their swivel region by a broken line.
FIG. 2 shows the yacht with keel parts swivelling out to sides opposite one another.
FIG. 3 shows the yacht heeling with the winged keel positioned vertically.
Figure 4:
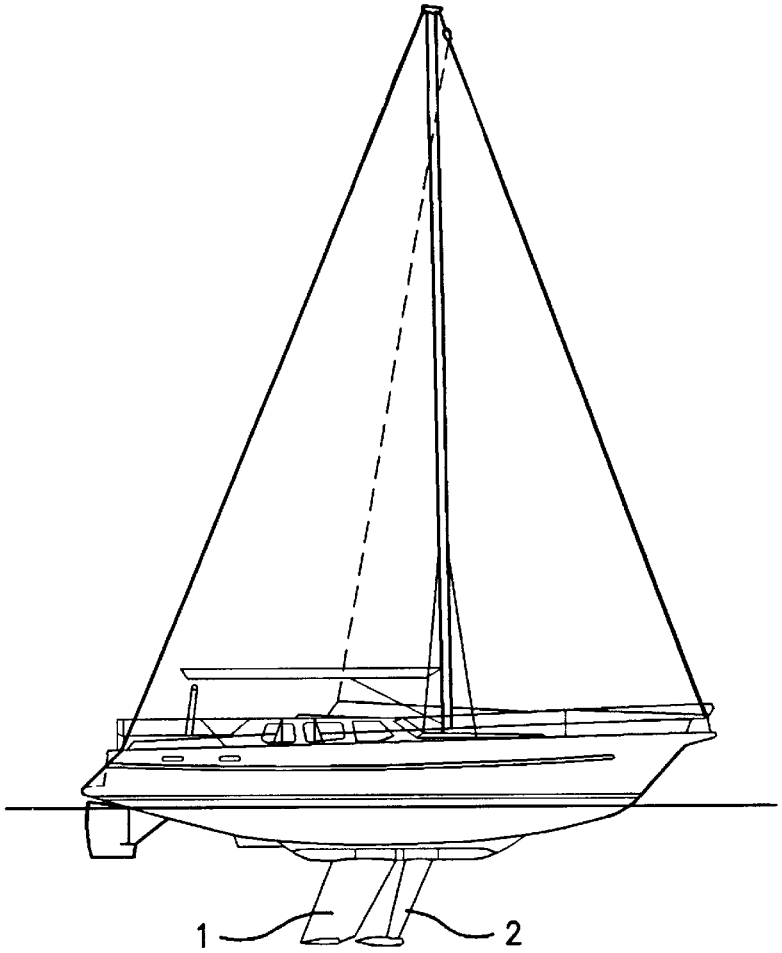
FIG. 4 shows a yacht in a side view with keel parts.
Figure 5:
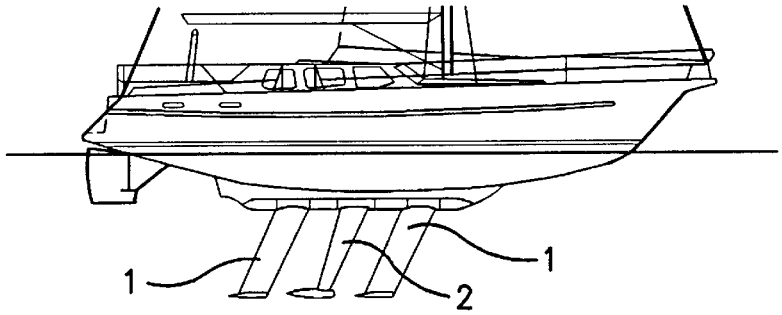
FIG. 5 shows in part a yacht with one ballast keel and two winged keels.
Figure 6:
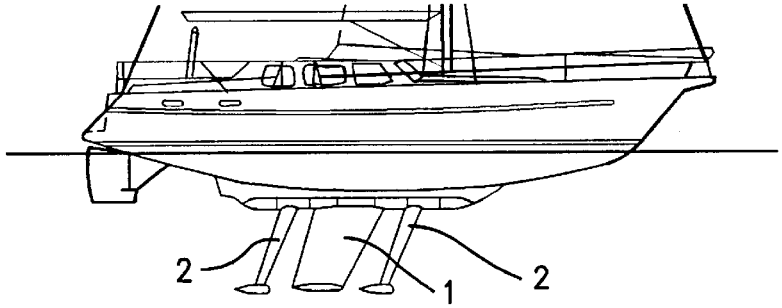
FIG. 6 shows in part a yacht with two ballast keels and one winged keel.
Figure 7:
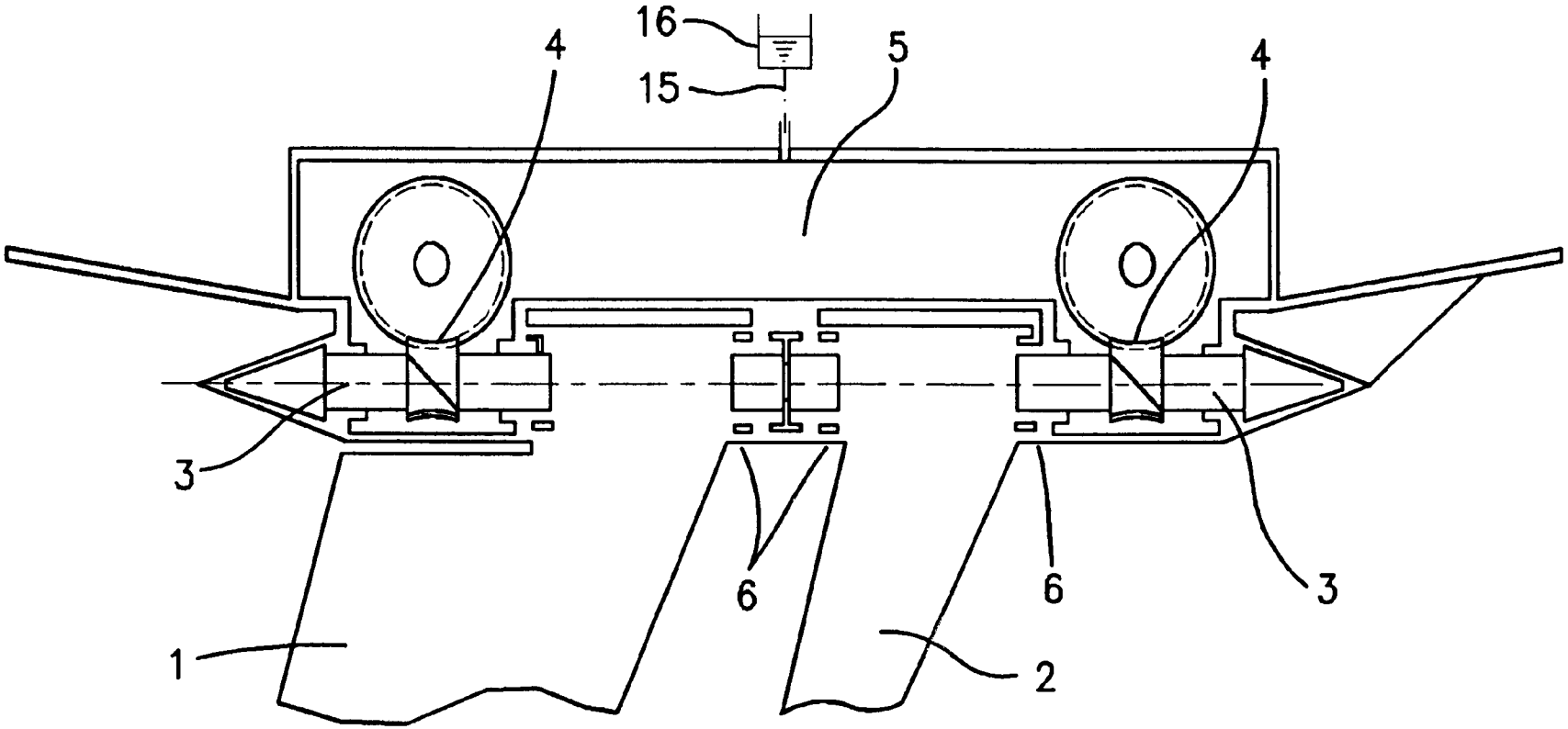
FIG. 7 schematically shows in a longitudinal cross section a mechanical drive for swivelling keel parts.
Figure 8:
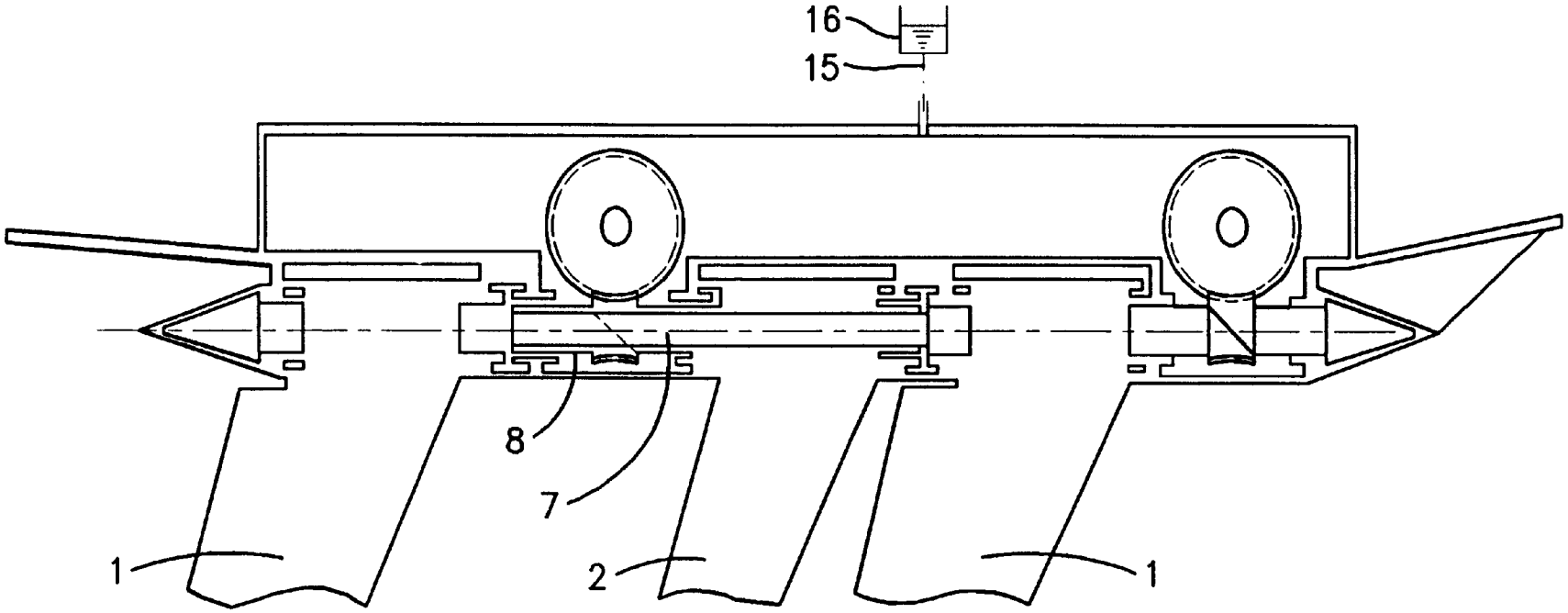
FIG. 8 shows a mechanical drive similar to that of FIG. 7.

Swivelling of keel parts 1 and 2 takes place here via piston rods 3 which are made as adjustable screw worms on their ends and which fit into pillow blocks 4 of keel parts 1 and 2, the pillow blocks being made as nuts. The adjustable screw worms which are guided on guide axles 8 and the nuts in pillow blocks 4 are made with high lead angle, with multiple threads, preferably with spherical threads to prevent self-locking, but for this reason to achieve very high efficiency.

Piston rods 3 are connected to pistons 5 which run in double-acting cylinders 6 and are guided via spherical guide sleeves provided in pistons 5 on guide rods 7 in cylinders 6 in order to prevent twisting of piston rods 3 around their axis.

Keel parts 1 and 2 are supported to swing horizontally via hollow pillow blocks 4 in bearings 9, preferably roller bearings, in the rigid part of the drives (cylinder 6 and bearing brackets 9) and are coupled via them to middle keel carrier 10 of the ship's hull.

Pistons 5 are pressurized via valves 11 from pump 12 directly or indirectly with the interposition of one or more chargeable hydraulic accumulators 13. Overflow valve 14 by opening allows keel parts 1 and/or 2 to be quickly positioned vertically when the course changes to another tack. The equivalent is achieved by pressure equalization between the charged cylinders of keel parts 1 and 2 by opening connecting line 29*a* or 29*b*. Here equalization of momentum and thus vertical positioning of the yacht also occur when two keels 1 and 2 are not yet vertical. Moreover here an energy potential remains. Chargeable hydraulic accumulator 13 has the advantage that charging can take place slowly, therefore with low power consumption, but discharging can proceed rapidly with high power delivery. Since a hydraulic accumulator loses pressure when volume is delivered, but to swivel a keel part up towards the end of the possible swivel angle the highest pressure is required, division of the hydraulic accumulator into several pressure stages is advantageous. In this case, with the potential energy of a keel which has been swivelled out to a considerable degree, therefore a keel loaded with the highest pressure stages, when this keel recovers, a lower pressure stage of the multicomponent hydraulic accumulator could be charged without outside energy supply.

Hydraulic fluid lines 15 and equalization vessels 16 which are located above the water surface for leaks, etc. exert a permanent hydrostatic pressure from the inside out on the underwater mechanism and its seals in joints 17 between the movable and stationary parts of keel parts 1 and 2 as claimed in the invention, so that no (sea) water can penetrate.

Figure 10:
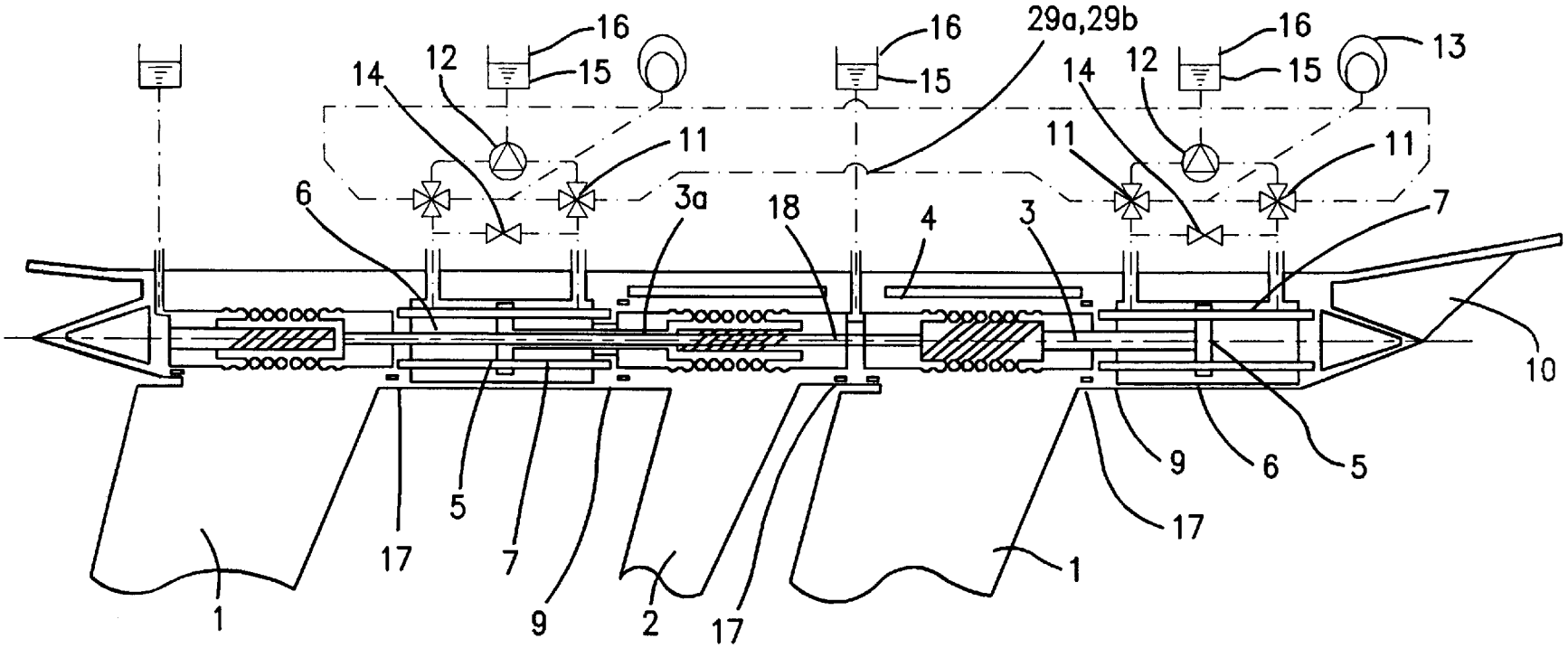
FIG. 10 shows a hydraulic power take off adapted to an embodiment with one ballast keel and two winged keels.

FIG. 10 shows a hydraulic power takeoff which is adapted to an embodiment with one ballast keel 2 and with two winged keels 1. The adjustable screw worms for winged keels 1 are joined to one another via connecting rods 18 in order to execute synchronous motion by actuating one piston 5. Connecting rod 18 is guided by screw piston rod 3*a* of ballast keel 2 located in between, the screw piston rod being made as a tube.

The same solution can be analogously applied to an embodiment of the invention with two ballast keels 2 and winged keel 1 located in between.

Figure 9:
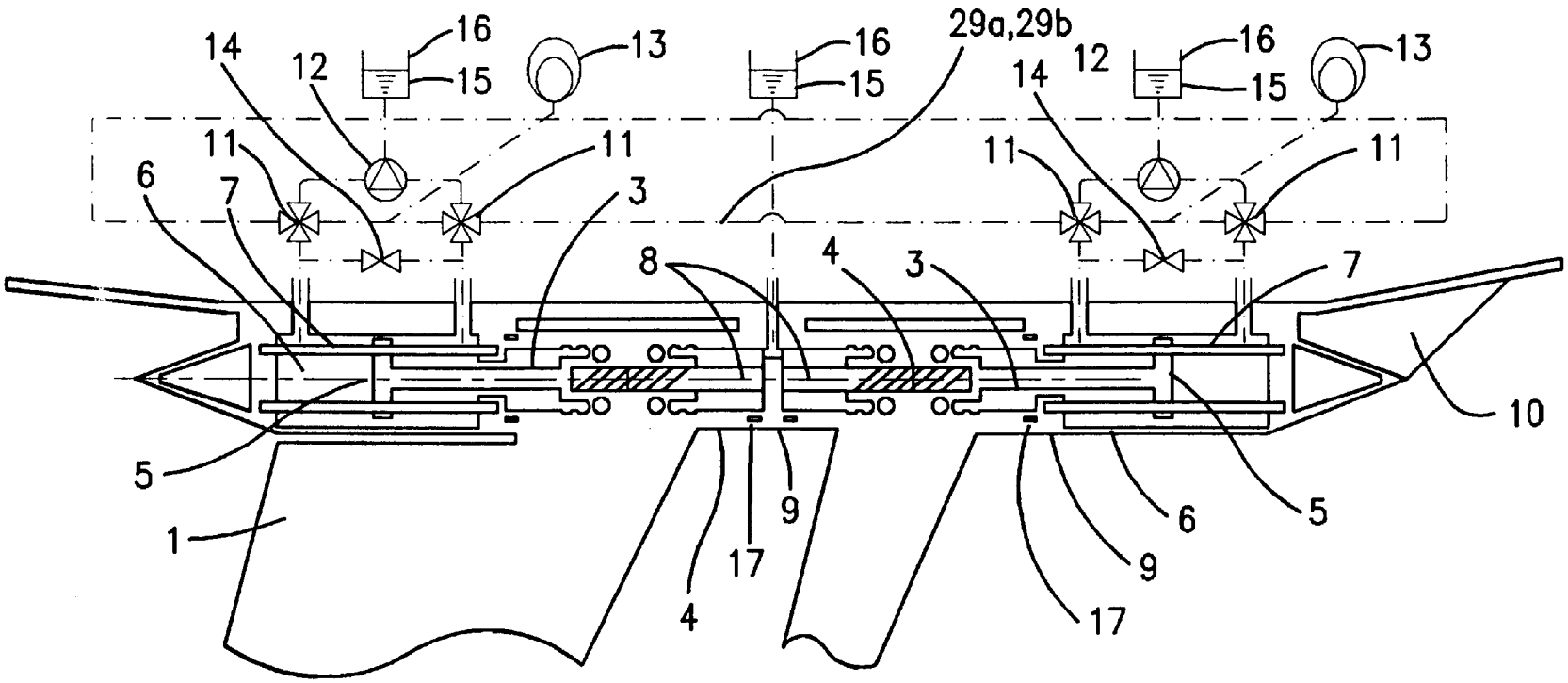
FIG. 9 shows in a longitudinal cross section one embodiment of a hydraulic drive for swivelling keel parts.
Figure 11:
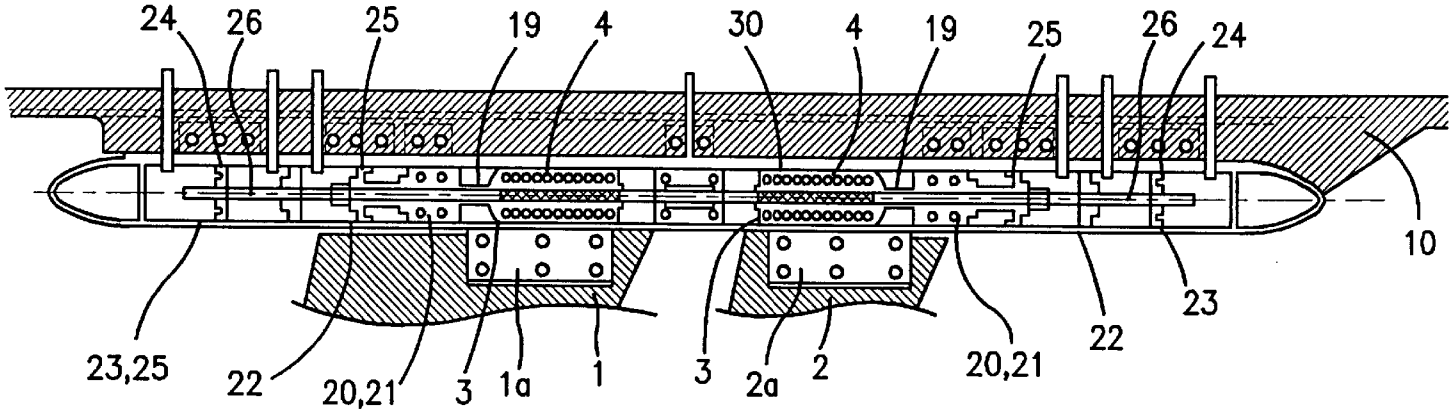
FIG. 11 shows another embodiment of a drive similar to that of FIG. 9.

FIG. 11 shows one embodiment similar to that of FIG. 9, in which piston rods 26 are coupled to spline shaft 19 which is supported against twisting via spherical roll bodies which run axially guided in cages 20 with rigid bearings 21 on middle keel carrier 10. In this embodiment, instead of one double acting cylinder each for keel parts 1 and 2, as shown, there can be two single-acting cylinders 22 and 23 with pistons 24 and 25 connected to piston rods 26. In addition, in the embodiment of FIGS. 11 and 12 adjustable screw worms 3 are separate parts connected to spline shafts 19 which are joined to piston rods 26 via round springs 27. Adjustable screw worms 4 which interact with spherical threaded spindles 3 are separate parts which are connected via springs 30 to keel parts 1 and 2.

Actual keel parts 1 and 2 can be connected to swivelling parts 1*a* and 2*a*, as are shown by way of example in FIGS. 11 through 14.

Figure 12:
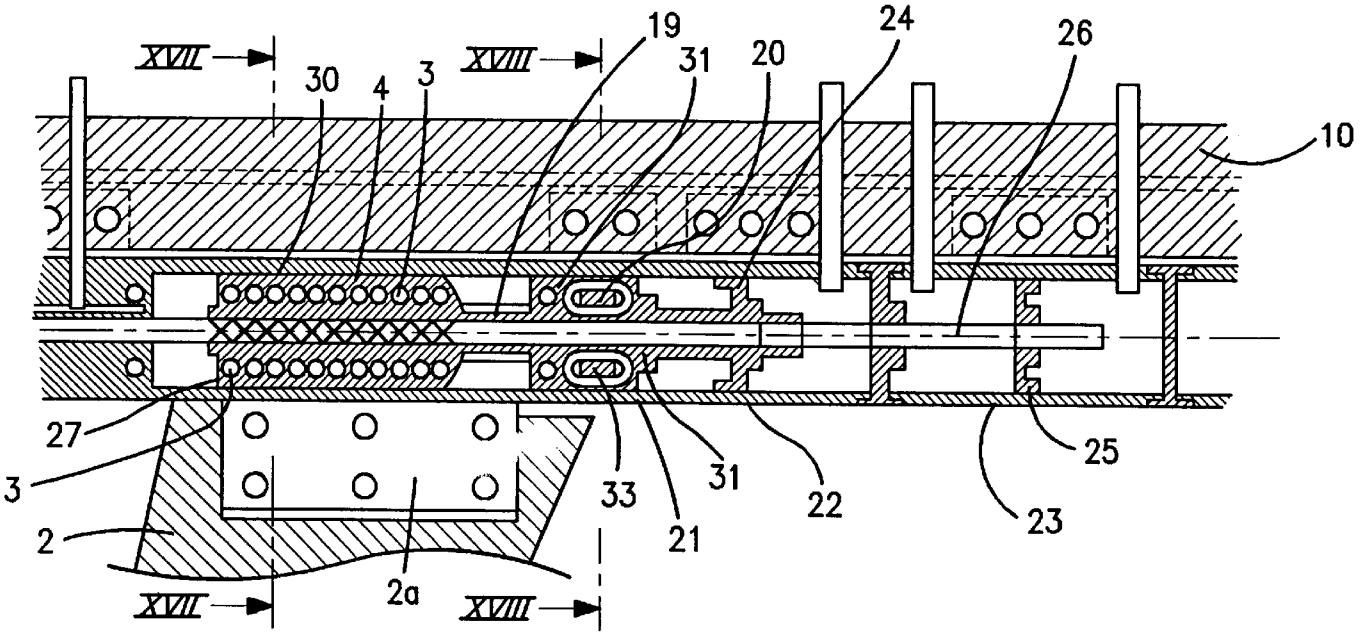
FIG. 12 shows an extract of an enlargement of the drive from FIG. 11.

FIG. 12 shows an extract of an enlargement of the embodiment of the drive from FIG. 11.

Figure 13:
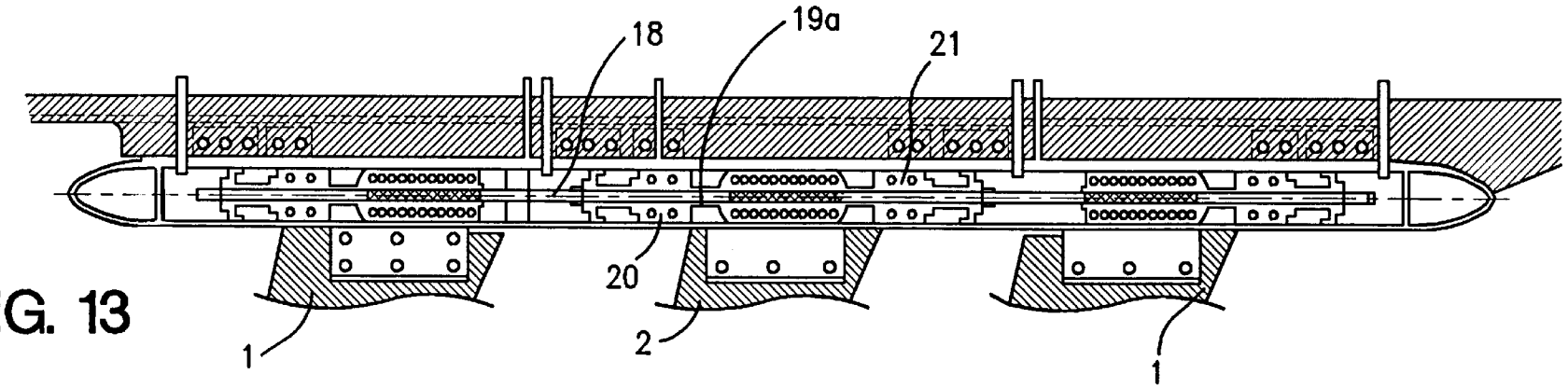
FIG. 13 shows a version similar to the embodiments of FIGS. 11 and 12 for three keel parts.

FIG. 13 shows a version similar to the embodiment of FIGS. 11 and 12 for three keel parts 1 and 2, two outer winged keels 1 similarly to FIG. 10 being coupled to one another for joint swivelling via connecting rod 18 which is also guided in the embodiment of FIG. 10 through hollow spline shaft 19*a* of middle ballast keel 2.

Figure 14:
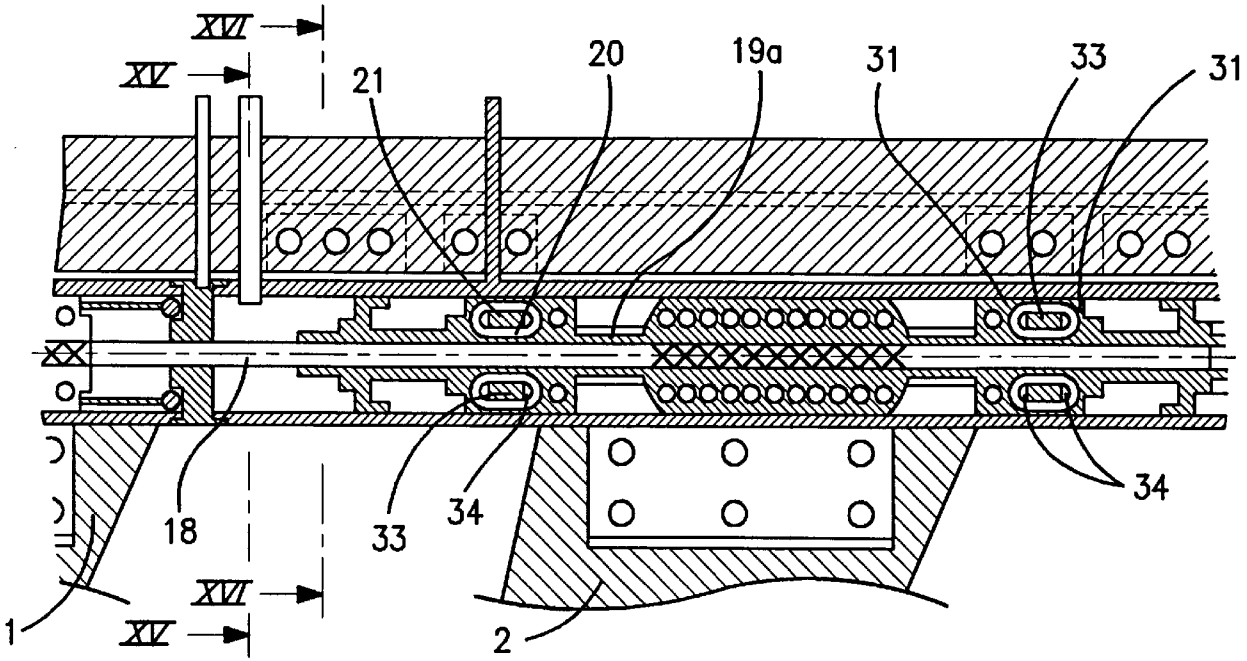
FIG. 14 shows an extract of an enlargement of the drive from FIG. 13.

FIG. 14 shows an extract of an enlargement of the embodiment of the drive from FIG. 13.

Figures 15, 16, 17, 18:
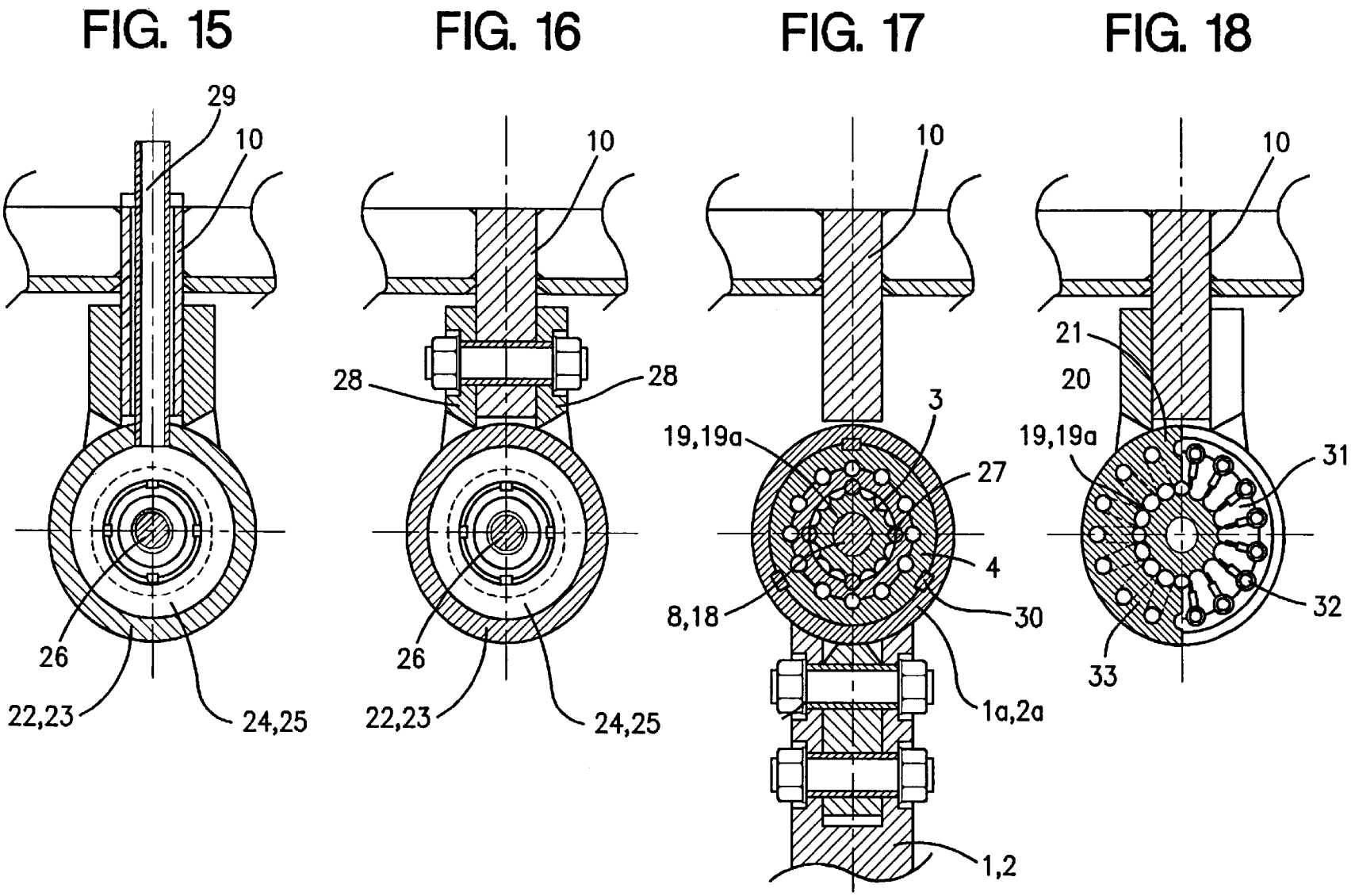
FIG. 15 shows a section along line A—A of FIG. 14.
FIG. 16 shows a section along line B—B of FIG. 14.
FIG. 17 shows a section along line C—C of FIG. 12.
FIG. 18 shows a section along line D—D of FIG. 12.

FIG. 15 shows a section along line A—A from FIG. 14 through one of hydraulic cylinders 22 or 23, pistons 24 or 25, piston rod 26, one possible suspension 28 of cylinder 22 or 23 on middle keel carrier 10, and pipe connection 29 for hydraulic fluid.

FIG. 16 shows a section along line B—B of FIG. 14 next to the hydraulic tube connection.

FIG. 17 shows a section along line C—C in FIG. 12 in the region of one keel part 1 or 2 with spline shaft 19*a* as a hollow shaft for guide axles 8 supported therein or connecting rod 18 which is guided through for three keel parts 1 and 2, furthermore spherical threaded spindle 3 which is joined via round springs 27 to spline shaft 19, and spherical threaded nuts 4 which are joined via springs 30 to keel parts 1*a* and 2*a* to be swivelled.

FIG. 18 shows in a section along line D—D in FIG. 12 the spherical spline shaft guide and locking piston 20 which is connected as bearing 21 to middle keel carrier 10. The spherical paths which are peripheral for each groove of spherical spline shaft 19 in locking piston 20 are bounded on the deflections by face disks 31 bored in a half-ring shape which are connected via screws 32 to inner bodies 33 of the spherical guides. This is shown in the right half of the section. In the deflection area from the inner to the outer spherical path inner bodies 33 have one radial slot 34 per spherical path, which is much narrower than the sphere diameter by which the spheres acquire guidance.

Figure 19:
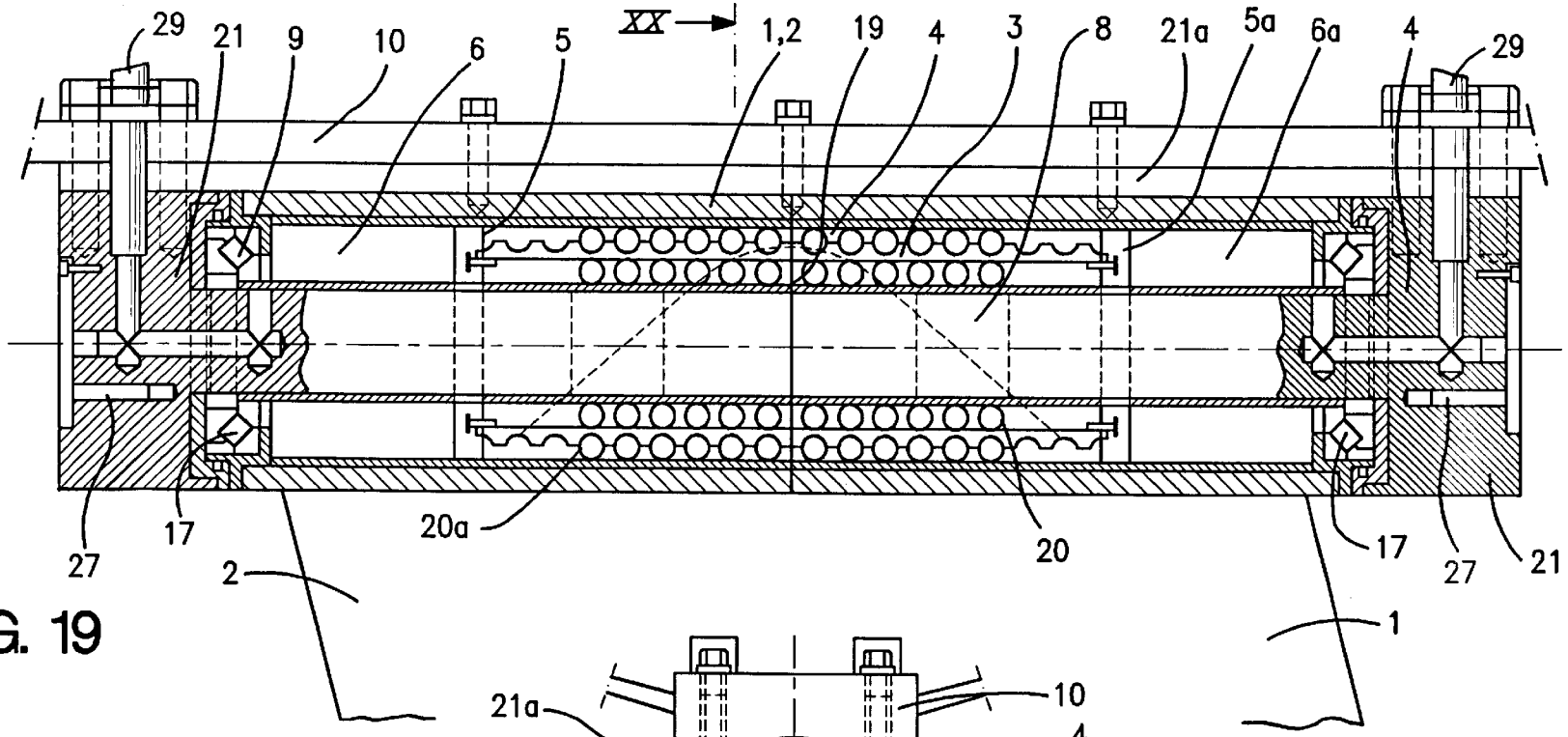
FIG. 19 shows another embodiment of the hydraulic approach.

FIG. 19 shows another embodiment of the hydraulic approach, the mechanism being shown for one of keel parts 1 and 2. Here two rigid bearings 21 which are connected to middle keel carrier 10 of the ship are connected via guide axle 8 to one another via round springs 27.

Sleeve 19 is sweated or cemented twist-proof onto guide axle 8 and in the middle part of its overall length acts as a spline shaft with spherical guide grooves. The hollow pipe which carries keel parts 1 or 2 is connected to inserted sleeve 4 which in the middle part of its overall length has a multiple spherical thread with high pitch angle, to be twist-proof, for example, by pressing in or cementing.

Piston rod 3 with pistons 5 and 5*a* on its ends is made as a sleeve in which a spherical thread which interacts with sleeve 4 via roll bodies is machined outside. On the inside of sleeve 4 spherical guide grooves are machined which interwork via roll bodies again with the spherical guide grooves of sleeve 19.

Both the spherical spline shaft roll bodies and also the spherical threaded spindle roll bodies are spaced apart in sleeve-shaped roll body cages 20 and 20*a*.

In the area outside of the spherical guides or spherical thread located in the middle part, then smooth sleeves 19 and 4 on both ends form one cylinder 6 or 6*a* each with annular cross section in which pistons 5 and 5*a* act loaded on one side against one another. The hydraulic fluid is supplied and discharged via end bearings 21 and via guide axis 8. Roller bearings 9 which accommodate the swinging moment and the axial thread thrust are guided in machined high quality steel parts which have joints 17 under internal pressure between the moving and rigid parts to one another.

Figure 20:
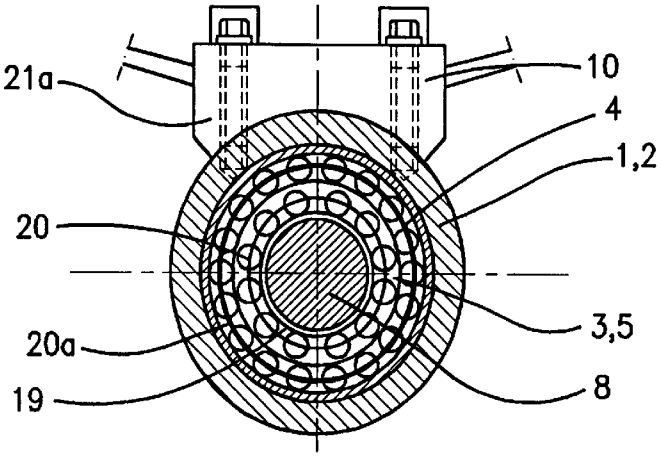
FIG. 20 shows a section along line E—E of FIG. 19.

FIG. 20 shows a section along line E—E of FIG. 19 in the area of the spherical spline shaft guide 19 and spherical threaded spindle 3 with spherical spline shaft counterguide and spherical threaded nut 4. Furthermore the section shows rail 21*a* which is connected to two end bearings 21.

In summary one embodiment of the invention can be described as follows.

A sailing yacht, in addition to its ballast keel, has at least one winged keel 1 which optionally also carries ballast. Both ballast keel 2 and winged keel 1 are mounted to swivel on the hull of the sail ship around an axis aligned essentially in the longitudinal direction of the sail ship. Thus, by swivelling ballast keel 2 the righting moment is changed, for example, increased. By swivelling winged keel 1 its lateral plane part can be changed and thus can be kept large even when the sailing yacht is heeling.

What is claimed is:

1. Keel for sail ships with at least two keel parts which are supported on a hull of the sail ship to swivel independently of one another around an axis aligned essentially in a longitudinal direction of the sail ship, using drives, wherein the two keel parts comprise at least one ballast keel and at least one winged keel, which are both supported to swivel via tubular pillow blocks in bearings attached externally to the ship's hull, the bearings for the ballast keel and the winged keel and the drives for adjusting the ballast keel and the winged keel being accommodated in at least one housing charged with a liquid under a permanent hydrostatic pressure which is higher than the pressure of water in an area of seals in joints between movable and stationary parts of the keel parts.

2. Keel as claimed in claim 1, wherein the ballast keel is nearer the bow of the ship, and the winged keel is nearer the stern of the ship, or conversely the ballast keel is nearer the stern and the winged keel is nearer the bow.

3. Keel as claimed in claim 1, wherein the winged keel on its free end away from the ship's hull carries ballast.

4. Keel as claimed in claim 1, wherein there are two ballast keels and one winged keel.

5. Keel as claimed in claim 4, wherein there is a ballast keel between two winged keels.

6. Keel as claimed in claim 4, wherein there are two winged keels and one ballast keel.

7. Keel as claimed in claim 6, wherein there is a winged keel located between ballast keels.

8. Keel as claimed in claim 1, wherein there is a drive to swivel the winged keel and a drive independent of the drive for the winged keel for swivelling the ballast keel.

9. Keel as claimed in claim 1, wherein a common drive is assigned to two winged keels.

10. Keel as claimed in claim 1, wherein the support for the ballast keel and the winged keel and the drives for adjusting the keel parts are accommodated in the housing charged with the pressurized liquid, which lubricates the drives.

11. Keel as claimed in claim 1, wherein the drives for adjusting the winged keel and/or ballast keel are worm gears.

12. Keel as claimed in claim 1, wherein the drives for adjusting the winged keel and/or ballast keel are spindle-feed nut drives.

13. Keel as claimed in claim 12, wherein the tubular pillow blocks of the winged keel and the ballast keel have an internal thread into which spindles of the drives fit.

14. Keel as claimed in claim 13, wherein the feed nuts of the spindle-feed nut drives are connected to the tubular pillow blocks of the winged keel and the ballast keel.

15. Keel as claimed in claim 12, wherein the spindles of the drive for the ballast keel and for the winged keel are coupled to hydraulic drives.

16. Keel as claimed in claim 12, wherein the threads of the spindles and feed nuts are made with high pitch angle, with multiple turns.

17. Keel as claimed in claim 12, wherein the threads of the spindles and feed nuts are made as spherical threads.

18. Keel as claimed in claim 12, wherein the spindles are coupled to piston rods of hydraulic adjustment drives.

19. Keel as claimed in claim 18, wherein the hydraulic adjustment drives can be charged with a hydraulic medium from a chargeable reservoir for the hydraulic medium.

20. Keel as claimed in claim 19, wherein the reservoir for the hydraulic medium is a multi-stage reservoir, storing the hydraulic medium with varying high pressures in at least two of its parts.

21. Keel as claimed in claim 20, wherein one of the adjustment drives at the start of swivelling out one keel part is charged with the hydraulic medium from a reservoir part with lower pressure and in the end segment of the swivel-out range from a reservoir part with higher pressure.

22. Keel as claimed in claim 20, wherein at the start of swivelling back one keel part, from a location which requires a higher pressure in the adjustment drive, the hydraulic medium from the adjustment drive is returned to the part of the reservoir charged with a lower pressure.

23. Keel as claimed in claim 18, wherein the hydraulic adjustment drives comprise pistons which are guided in actuating cylinders blocked against twisting around their axis.

24. Keel as claimed in claim 23, wherein the piston rods of the actuating cylinders are coupled to spline shafts which are guided stationary on guides attached to the ship, without the capacity to twist.

25. Keel as claimed in claim 24, wherein the guides are cages in which spherical roll bodies which fit into grooves of spline shafts are held.

26. Keel as claimed in claim 25, wherein the spherical roll bodies are guided in the cages along a closed path.

27. Keel as claimed in claim 23, wherein there is a guide axle which is rigidly connected to the ship's hull via a keel carrier, and wherein said pistons are guided on said guide axle and are joined to one another via a hollow piston rod.

28. Keel as claimed in claim 27, wherein there is a piston rod between the pistons which has internal axially parallel grooves for holding roll bodies which fit into axially parallel grooves which are made on the outside of the guide axle between the pistons.

29. Keel as claimed in claim 28, wherein the guide axle has outer grooves which are made on the outside of a sleeve connected to the guide axle.

30. Keel as claimed in claim 27, wherein a pipe which carries the winged keel or the ballast keel, has a multiple spherical inner thread for coupling via roll bodies to a spherical thread formed on the outside of the piston rod.

31. Keel as claimed in claim 30, wherein the inner thread of the pipe which carries the winged keel or ballast keel is formed on a sleeve connected to it.

32. Keel as claimed in claim 30, wherein the spherical thread is a non-selflocking thread with a high pitch angle.

* * * * *